US008122980B2

(12) United States Patent
Hall et al.

(10) Patent No.: US 8,122,980 B2
(45) Date of Patent: Feb. 28, 2012

(54) ROTARY DRAG BIT WITH POINTED CUTTING ELEMENTS

(75) Inventors: David R. Hall, Provo, UT (US); Ronald B. Crockett, Payson, UT (US); John Bailey, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 312 days.

(21) Appl. No.: 11/766,975

(22) Filed: Jun. 22, 2007

(65) Prior Publication Data

US 2008/0314647 A1 Dec. 25, 2008

(51) Int. Cl.
*E21B 10/43* (2006.01)

(52) U.S. Cl. ..... 175/432; 175/434

(58) Field of Classification Search ..... 175/432, 175/428, 427

See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford |
| 2,169,223 | A | 8/1931 | Christian |
| 1,821,474 | A | 9/1931 | Mercer |
| 1,879,177 | A | 9/1932 | Gault |
| 2,054,255 | A | 9/1936 | Howard |
| 2,064,255 | A | 12/1936 | Garfield |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,294,186 | A | 12/1966 | Buell |
| 3,301,339 | A | 1/1967 | Pennebaker, Jr. |
| 3,379,264 | A | 4/1968 | Cox |

(Continued)

OTHER PUBLICATIONS

SME Mining Engineering Handbook, pp. 691, 692; 1992.*

(Continued)

*Primary Examiner* — John Kreck
(74) *Attorney, Agent, or Firm* — Brinks Hofer Gilson & Lione

(57) ABSTRACT

In one aspect of the invention a rotary drag bit has a bit body intermediate a shank and a working surface. The working surface has a plurality of blades converging at a center of the working surface and diverging towards a gauge of the working surface. At least one blade has a cutting element with a carbide substrate bonded to a diamond working end with a pointed geometry. The diamond working end has a central axis which intersects an apex of the pointed geometry such that the axis is oriented within a 15 degree rake angle.

23 Claims, 11 Drawing Sheets

U.S. PATENT DOCUMENTS 3,429,390 A 2/1969 Bennett
3,493,165 A 2/1970 Schonfeld
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Hams
4,106,577 A 8/1978 Summer
4,109,737 A 8/1978 Bovenkerk
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,332,051 A * 7/1994 Knowlton ..... 175/430
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,535,839 A * 7/1996 Brady ..... 175/427
5,560,440 A 10/1996 Tibbitts
5,568,838 A 10/1996 Struthers
5,655,614 A 8/1997 Azar
5,678,644 A 10/1997 Fielder
5,732,784 A * 3/1998 Nelson ..... 175/385
5,794,728 A 8/1998 Palmberg
5,848,657 A 12/1998 Flood
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott et al.
5,992,547 A 11/1999 Caraway
5,992,548 A 11/1999 Silva
6,003,623 A * 12/1999 Miess ..... 175/430
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,199,645 B1 * 3/2001 Anderson et al. ..... 175/426
6,202,761 B1 3/2001 Forney
6,213,226 B1 4/2001 Eppink
6,223,824 B1 5/2001 Moyes
6,269,893 B1 8/2001 Beaton
6,290,007 B2 * 9/2001 Beuershausen et al. ..... 175/408
6,332,503 B1 12/2001 Pessier
6,340,064 B2 1/2002 Fielder
6,364,034 B1 4/2002 Schoeffler
6,394,200 B1 5/2002 Watson
6,408,959 B2 6/2002 Bertagnolli
6,439,326 B1 8/2002 Huang
6,474,425 B1 11/2002 Truax
6,484,825 B2 11/2002 Watson
6,484,826 B1 11/2002 Anderson
6,510,906 B1 1/2003 Richert
6,513,606 B1 2/2003 Krueger
6,533,050 B2 3/2003 Malloy
6,594,881 B2 7/2003 Tibbitts
6,601,454 B1 8/2003 Bolnan
6,622,803 B2 9/2003 Harvey
6,668,949 B1 12/2003 Rives
6,672,406 B2 1/2004 Beuershausen
6,729,420 B2 5/2004 Mensa-Wilmot
6,732,817 B2 5/2004 Dewey
6,822,579 B2 11/2004 Goswani
6,929,076 B2 8/2005 Fanuel et al.
6,953,096 B2 10/2005 Glenhill
2001/0004946 A1 6/2001 Jensen
2001/0040053 A1 11/2001 Beuershausen
2003/0213621 A1 11/2003 Britten
2004/0238221 A1 12/2004 Runia
2004/0256155 A1 12/2004 Kriesels
2006/0086537 A1 * 4/2006 Dennis ..... 175/57

OTHER PUBLICATIONS

G. Jeffery Hoch, Is There Room for Geothermal Energy, Innovation: America's Journal of Technology Communication, Dec. 2006/Jan. 2007, http://www.innovation-america.org/.

US Department of Energy, Geothermal Drilling Faster and Cheaper is Better, Geothermal Today, May 2000, p. 28, National Renewable Energy Laboratory Golden, Colorado.

David A. Glowka, et al., Progress in the Advanced Synthetic-Diamond Drill Bit Program, 1995.

Mark A. Taylor, The State of Geothermal Technology Part 1: Subsurface Technology, pp. 29-30, Geothermal Energy Association, Nov. 2007, Washington, D.C.

Christopher J. Durrand, Super-hard, Thick Shaped PDC Cutters for Hard Rock Drilling: Development and Test Results, Feb. 3, 2010, Geothermal Reservoir Engineering, Stanford, California.

Dan Jennejohn, Research and Development in Geothermal Exploration and Drilling, pp. 5, Dec. 18-19, 2009, Geothermal Energy Association, Washington, D.C.

* cited by examiner

ROTARY DRAG BIT WITH POINTED CUTTING ELEMENTS

BACKGROUND OF THE INVENTION

1. Field

This invention relates to drill bits, specifically drill bit assemblies for use in oil, gas and geothermal drilling. More particularly, the invention relates to cutting elements in rotary drag bits comprised of a carbide substrate with a non-planar interface and an abrasion resistant layer of super hard material affixed thereto using a high pressure high temperature press apparatus. Such cutting elements typically comprise a super hard material layer or layers formed under high temperature and pressure conditions usually in a press apparatus designed to create such conditions, cemented to a carbide substrate containing a metal binder or catalyst such as cobalt.

2. Relevant Technology

A cutting element or insert is normally fabricated by placing a cemented carbide substrate into a container or cartridge with a layer of diamond crystals or grains loaded into the cartridge adjacent one fact of the substrate. A number of such cartridges are typically loaded into a reaction cell and placed in the high-pressure/high-temperature (HPHT) apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the super hard abrasive layer or the substrate thereby reducing or eliminating the cutting elements efficacy and decreasing overall drill bit wear life. The super hard material layer of a cutting element sometimes delaminates from the carbide substrate after the sintering process as well as during percussive and abrasive use. Damage typically found in drag bits may be a result of shear failures, although non-shear modes of failure are not uncommon. The interface between the super hard material layer and substrate is particularly susceptible to non-shear failure modes due to inherent residual stresses.

U.S. Pat. No. 6,332,503 by Pessier et al, which is herein incorporated by reference for all that it contains, discloses an array of chisel-shaped cutting elements are mounted to the face of a fixed cutter bit. Each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary bit for rock drilling comprising a plurality of cutting elements mounted by interence-fit in recesses in the crown of the drill bit. Each cutting element comprises an elongated pin with a thin layer of polycrystalline diamond bonded to the free end of the pin.

US Patent Application Serial No. 2001/0004946 by Jensen, although now abandoned, is herein incorporated by reference for all that it discloses. Jensen teaches that a cutting element or insert with improved wear characteristics while maximizing the manufacturability and cost effectiveness of the insert. This insert employs a superabrasive diamond layer of increased depth and by making use of a diamond layer surface that is generally convex.

BRIEF SUMMARY OF THE INVENTION

In one aspect of the present invention, a rotary drag bit has a bit body intermediate a shank and a working surface, the working surface having a plurality of blades converging at a center of the working surface and diverging towards a gauge of the working surface. At least one blade has a cutting element with a carbide substrate bonded to a diamond working end with a pointed geometry; the diamond working end having a central axis which intersects an apex of the pointed geometry; wherein the axis is oriented within a 15 degree rake angle.

In some embodiments, the rotary drag bit, has a bit body intermediate a shank and a working surface, the working surface having a cutting element with a carbide substrate bonded to a diamond working end with a pointed geometry; the diamond working end having a central axis which intersects an apex of the pointed geometry; wherein the axis is oriented within a 15 degree rake angle.

In some embodiments, the rake angle may be negative and in other embodiments, the axis may be substantially parallel with the shank portion of the bit. The cutting element may be attached to a cone portion a nose portion, a flank portion and/or a gauge portion of at least one blade. Each blade may comprise a cutting element with a pointed geometry.

The pointed geometry may comprise 0.050 to 0.200 inch radius and may comprise a thickness of at least 0.100 inches. The diamond working end may be processed in a high temperature high pressure press. The diamond working end may be cleaned in vacuum and sealed in a can by melting a sealant disk within the can prior to processing in the high temperature high pressure press. A stop off also within the can may control a flow of the melting disk. The diamond working end may comprise infiltrated diamond. In some embodiments, the diamond working end may comprise a metal catalyst concentration of less than 5 percent by volume. The diamond working end may be bonded to the carbide substrate at an interface comprising a flat normal to the axis of the cutting element. A surface of the diamond working end may be electrically insulating. The diamond working end may comprise an average diamond grain size of 1 to 100 microns. The diamond working end may comprise a characteristic of being capable of withstanding greater than 80 joules in a drop test with carbide targets The rotary drag bit may further comprise a jack element with a distal end extending beyond the working face. In other embodiments, another cutting element attached to the at least one blade may comprises a flat diamond working end. The cutting element with the flat diamond working end may precede or trail behind the cutting element with the pointed geometry in the direction of the drill bit's rotation. The cutting element with the pointed geometry may be in electric communication with downhole instrumentation, such as a sensor, actuator, piezoelectric device, transducer, magnetostrictive device, or a combination thereof.

DETAILED DESCRIPTION OF THE INVENTION AND THE PREFERRED EMBODIMENT

Figure 1:
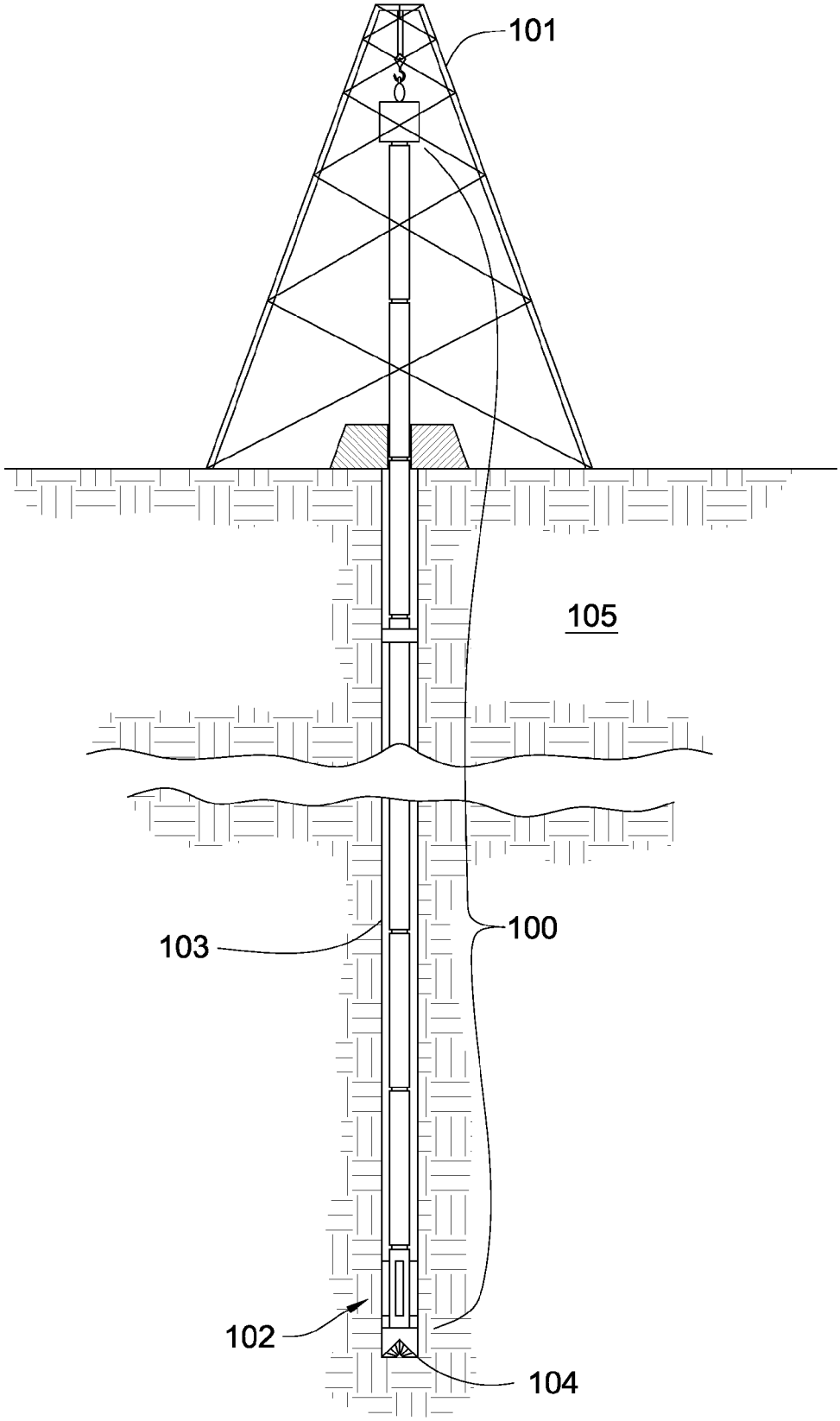
FIG. 1 is a perspective diagram of an embodiment of a drill string suspended in a bore hole.

Referring now to the figures, FIG. 1 is a cross-sectional diagram of an embodiment of a drill string 100 suspended by a derrick 101. A bottom hole assembly 102 is located at the bottom of a bore hole 103 and comprises a rotary drag bit 104. As the drill bit 104 rotates down hole the drill string 100 advances farther into the earth. The drill string 100 may penetrate soft or hard subterranean formations 105.

Figure 2:
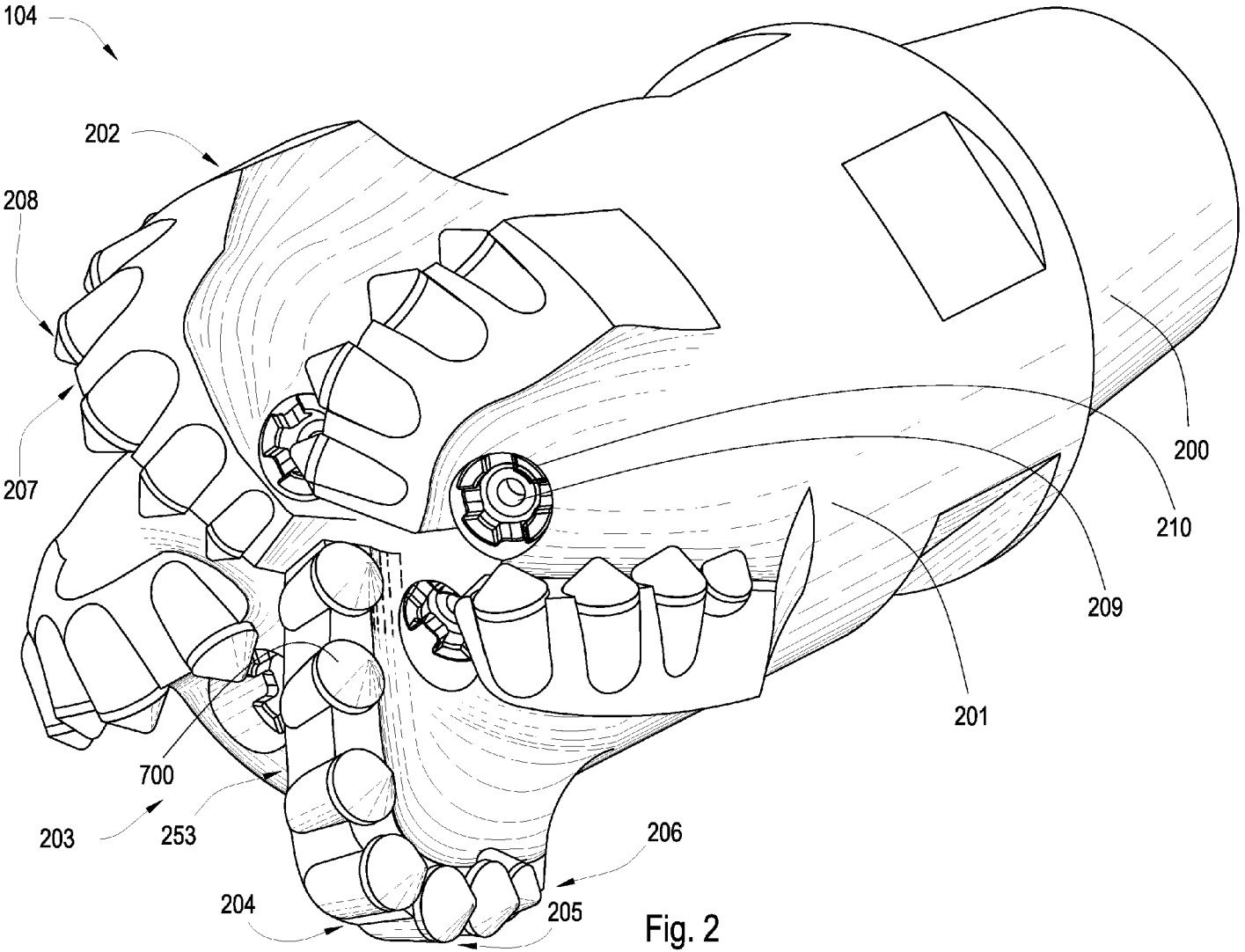
FIG. 2 is a side perspective diagram of an embodiment of a drill bit.

FIG. 2 discloses a drill bit 104 of the present invention. The drill bit 104 comprises a shank 200 which is adapted for connection to a down hole tool string such as drill string comprising drill pipe, drill collars, heavy weight pipe, reamers, jars, and/or subs. In some embodiments coiled tubing or other types of tool string may be used. The drill bit 104 of the present invention is intended for deep oil and gas drilling, although any type of drilling application is anticipated such as horizontal drilling, geothermal drilling, mining, exploration, on and off-shore drilling, directional drilling, water well drilling and any combination thereof. The bit body 201 is attached to the shank 200 and comprises an end which forms a working face 202. Several blades 203 extend outwardly from the bit body 201, each of which may comprise a plurality of cutting elements 208 which may have a pointed geometry 700. A drill bit 104 most suitable for the present invention may have at least three blades 203; preferably the drill bit 104 will have between three and seven blades 203. The blades 203 collectively form an inverted conical region 205. Each blade 203 may have a cone portion 253, a nose portion 206, a flank portion 207, and a gauge portion 204. Cutting elements 208 may be arrayed along any portion of the blades 203, including the cone portion 253, nose portion 206, flank portion 207, and gauge portion 204. A plurality of nozzles 209 are fitted into recesses 210 formed in the working face 202. Each nozzle 209 may be oriented such that a jet of drilling mud ejected from the nozzles 209 engages the formation before or after the cutting elements 208. The jets of drilling mud may also be used to clean cuttings away from drill bit 104. In some embodiments, the jets may be used to create a sucking effect to remove drill bit cuttings adjacent the cutting elements 208 by creating a low pressure region within their vicinities.

The pointed cutting elements are believed to increase the ratio of formation removed upon each rotation of the drill bit to the amount of diamond worn off of the cutting element per rotation of the drill bit over the traditional flat shearing cutters of the prior art. Generally the traditional flat shearing cutters of the prior art will remove 0.010 inch per rotation of a Sierra White Granite wheel on a VTL test with 4200-4700 pounds loaded to the shearing element with the granite wheel. The granite removed with the traditional flat shearing cutter is generally in a powder form. With the same parameters, the pointed cutting elements with a 0.150 thick diamond and with a 0.090 to 0.100 inch radius apex positioned substantially at a zero rake removed over 0.200 inches per rotation in the form of chunks.

Figure 3:
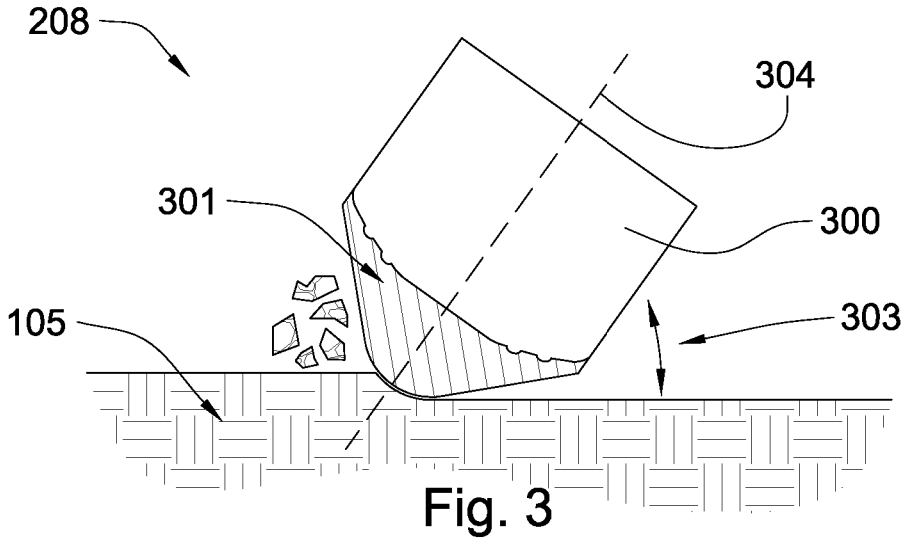
FIG. 3 is a cross-sectional diagram of an embodiment of a cutting element.
Figure 3A:
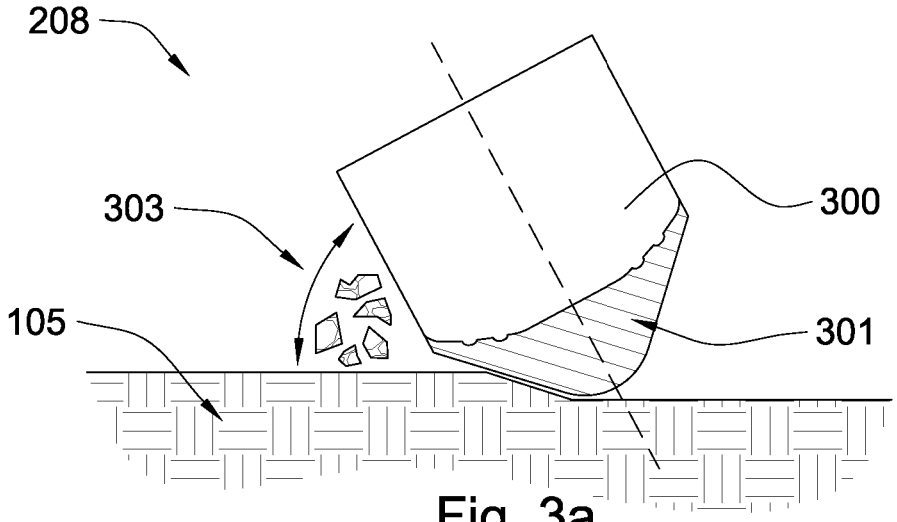
FIG. 3*a* is a cross-sectional diagram of another embodiment of a cutting element.
Figure 3B:
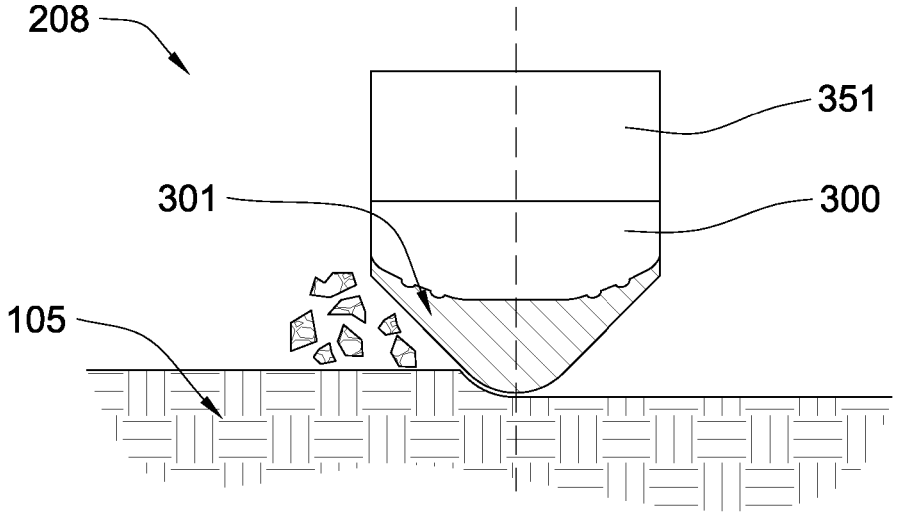
FIG. 3*b* is a cross-sectional diagram of another embodiment of a cutting element.

FIGS. 3 through 3*b* disclose the cutting element 208 in contact with a subterranean formation 105 wherein the axis 304 is oriented within a 15 degree rake angle 303. The rake angle 303 may be positive as shown in FIG. 3, negative as shown in FIG. 3*a*, or it may comprises a zero rake as shown in FIG. 3*b*. Cutting element in the gauge portion, flank portion, nose portion, or cone portion of the blades may have a negative rake, positive rake, or zero rake. The positive rake may be between positive 15 degrees and approaching a zero rake, while the negative rake may also be between negative 15 degrees and approaching a zero rake. In some embodiments, the substrate may be brazed to a larger carbide piece 351. This may be advantageous since it may be cheaper to bond the small substrate to the diamond working end in the press. The larger carbide piece may then be brazed, bonded, or press fit into the bit blade. The bit blade may be made of carbide or steel.

Figure 3C:
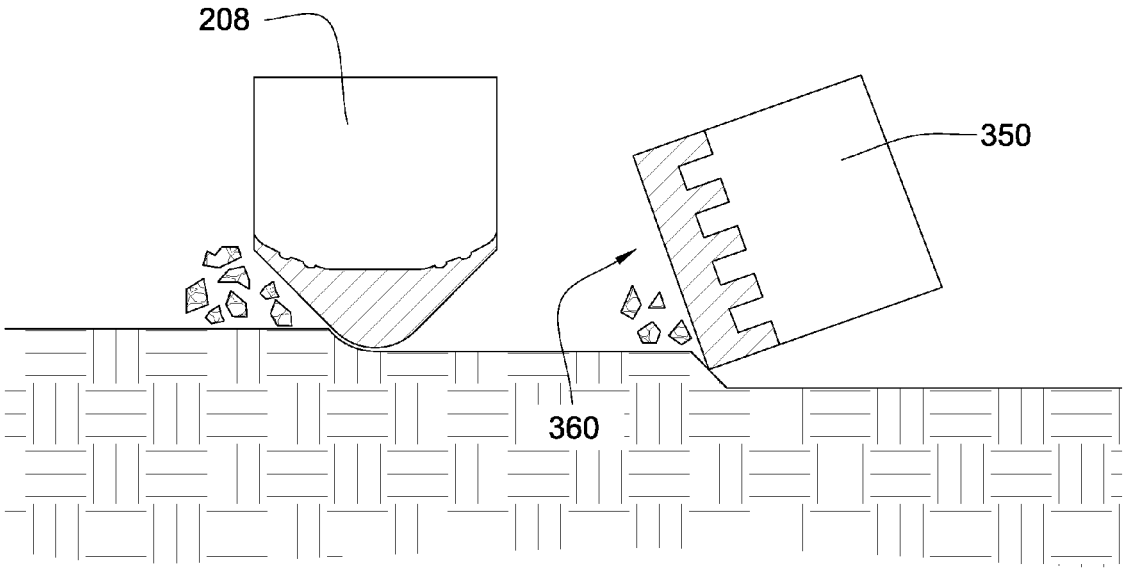
FIG. 3*c* is a cross-sectional diagram of another embodiment of a cutting element.
Figure 3D:
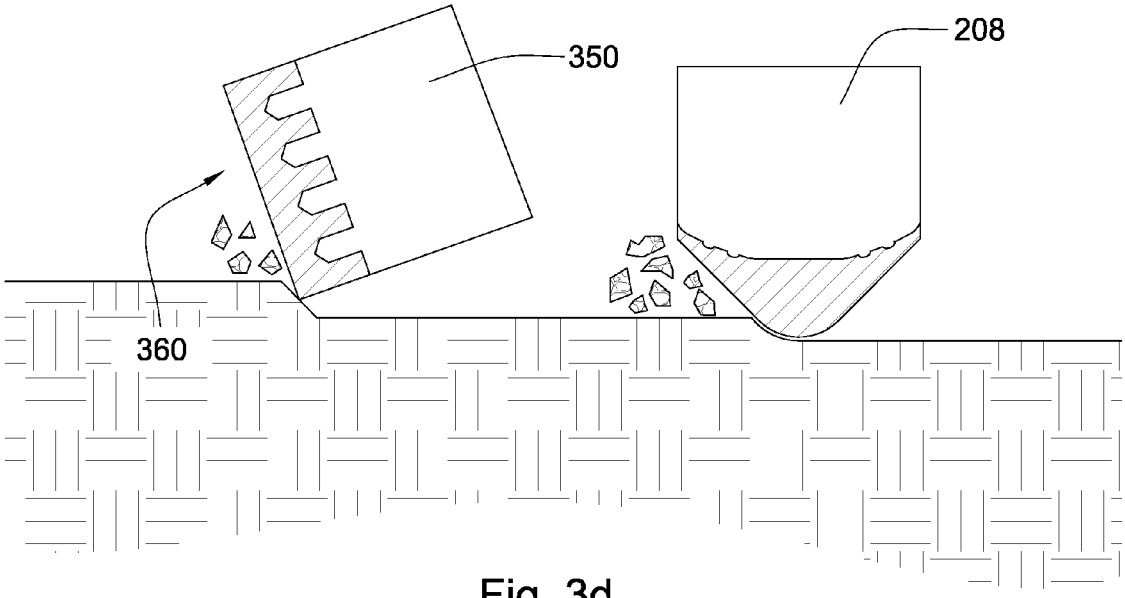
FIG. 3*d* is a cross-sectional diagram of another embodiment of a cutting element.

FIG. 3*c* discloses an embodiment of a cutting element 208 with a pointed diamond working end preceding another cutting element 350 with a flat diamond working end 360. FIG. 3*d* discloses the cutting element 208 trailing behind the other cutting element 360.

Figure 4:
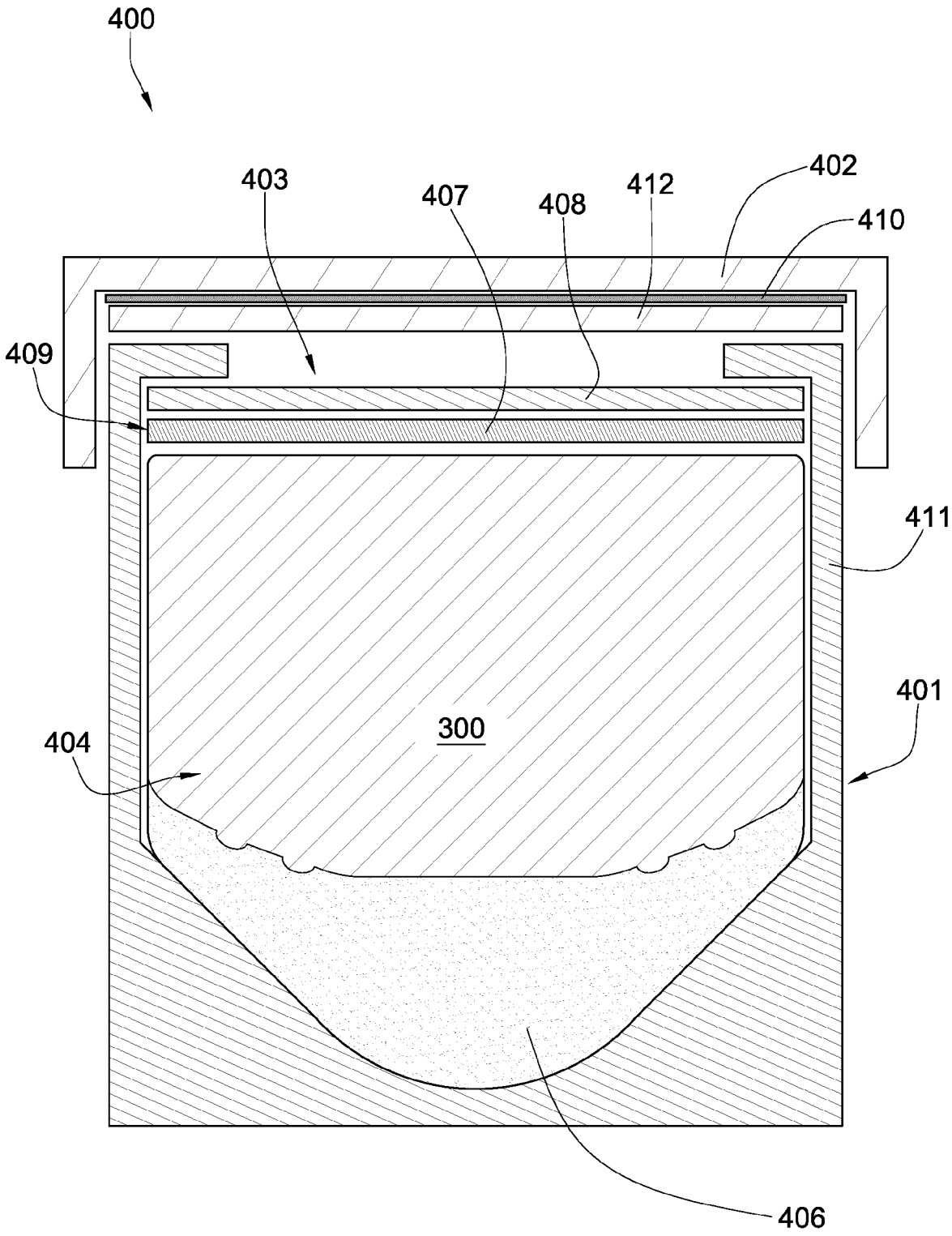
FIG. 4 is a cross-sectional diagram of an embodiment of an assembly for HPHT processing.

FIG. 4 is a cross-sectional diagram of an embodiment for a high pressure high temperature (HPHT) processing assembly 400 comprising a can 401 with a cap 402. At least a portion of the can 401 may comprise niobium, a niobium alloy, a niobium mixture, another suitable material, or combinations thereof. At least a portion of the cap 402 may comprise a metal or metal alloy.

A can such as the can of FIG. 4 may be placed in a cube adapted to be placed in a chamber of a high temperature high pressure apparatus. Prior to placement in a high temperature high pressure chamber the assembly may be placed in a heated vacuum chamber to remove the impurities from the assembly. The chamber may be heated to 1000 degrees long enough to vent the impurities that may be bonded to superhard particles such as diamond which may be disposed within the can. The impurities may be oxides or other substances from the air that may readily bond with the superhard particles. After a reasonable venting time to ensure that the particles are clean, the temperature in the chamber may increase to melt a sealant 410 located within the can adjacent the lids 412, 408. As the temperature is lowered the sealant solidifies and seals the assembly. After the assembly has been sealed it may undergo HPHT processing producing a cutting element with an infiltrated diamond working end and a metal catalyst concentration of less than 5 percent by volume which may allow the surface of the diamond working end to be electrically insulating.

The assembly 400 comprises a can 401 with an opening 403 and a substrate 300 lying adjacent a plurality of super hard particles 406 grain size of 1 to 100 microns. The super hard particles 406 may be selected from the group consisting of diamond, polycrystalline diamond, thermally stable products, polycrystalline diamond depleted of its catalyst, polycrystalline diamond having nonmetallic catalyst, cubic boron nitride, cubic boron nitride depleted of its catalyst, or combinations thereof. The substrate 300 may comprise a hard metal such as carbide, tungsten-carbide, or other cemented metal carbides. Preferably, the substrate 300 comprises a hardness of at least 58 HRc.

A stop off 407 may be placed within the opening 403 of the can 401 in-between the substrate 300 and a first lid 408. The stop off 407 may comprise a material selected from the group consisting of a solder/braze stop, a mask, a tape, a plate, and sealant flow control, boron nitride, a non-wettable material or a combination thereof. In one embodiment the stop off 407 may comprise a disk of material that corresponds with the opening of the can 401. A gap 409 between 0.005 to 0.050 inches may exist between the stop off 407 and the can 401. The gap 409 may support the outflow of contamination while being small enough size to prevent the flow of a sealant 410 into the mixture 404. Various alterations of the current configuration may include but should not be limited to; applying a stop off 407 to the first lid 408 or can by coating, etching, brushing, dipping, spraying, silk screening painting, plating, baking, and chemical or physical vapor deposition techniques. The stop off 407 may in one embodiment be placed on any part of the assembly 400 where it may be desirable to inhibit the flow of the liquefied sealant 410.

The first lid 408 may comprise niobium or a niobium alloy to provide a substrate that allows good capillary movement of the sealant 410. After the first lid 408 is installed within the can, the walls 411 of the can 401 may be folded over the first lid 408. A second lid 412 may then be placed on top of the folded walls 401. The second lid 412 may comprise a material selected from the group consisting of a metal or metal alloy. The metal may provide a better bonding surface for the sealant 410 and allow for a strong bond between the lids 408, 412, can 401 and a cap 402. Following the second lid 412 a metal or metal alloy cap 402 may be placed on the can 401.

Figure 5B:
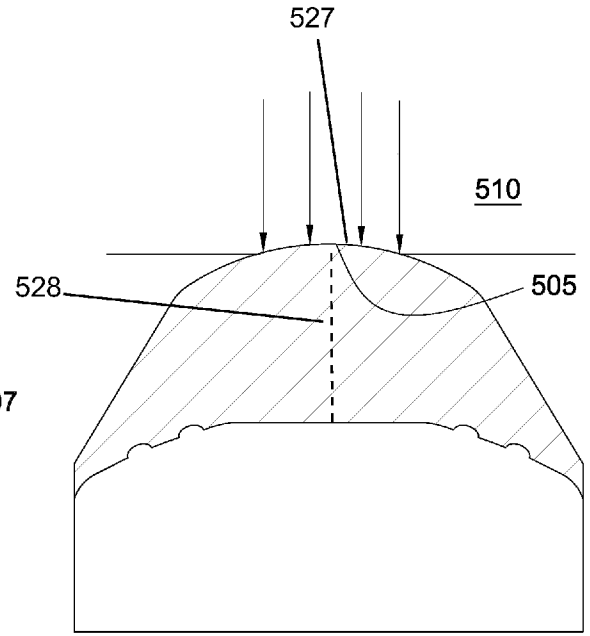
FIG. 5*b* is a cross-sectional diagram of another embodiment of a cutting element.
Figure 5A:
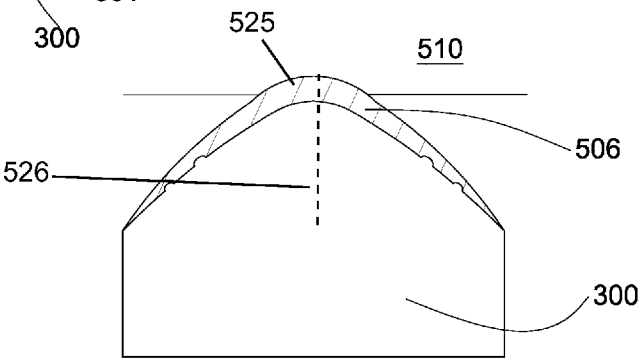
FIG. 5*a* is a cross-sectional diagram of another embodiment of a cutting element.
Figure 5:
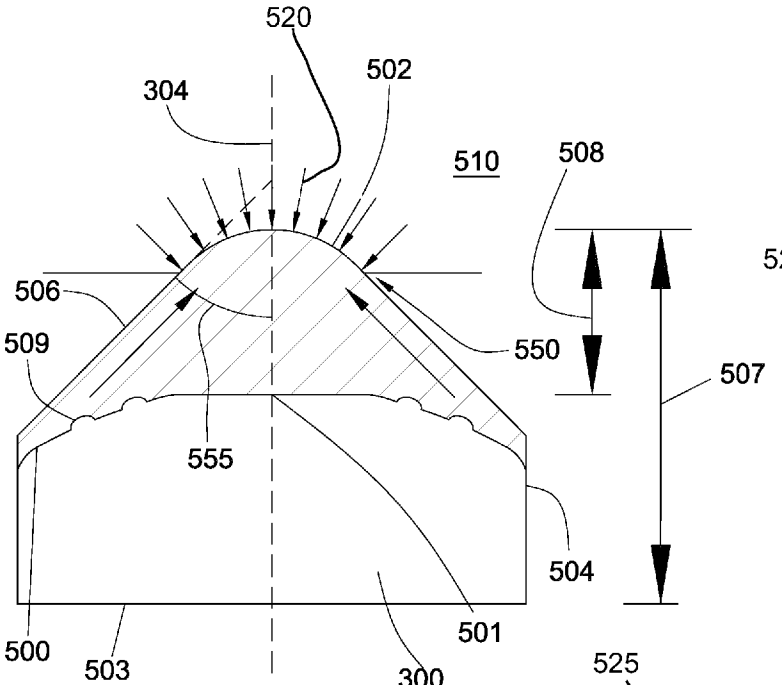
FIG. 5 is a cross-sectional diagram of another embodiment of a cutting element

Now referring to FIG. 5, the substrate 300 comprises a tapered surface 500 starting from a cylindrical rim 504 of the substrate and ending at an elevated, flatted, central region 501 formed in the substrate. The diamond working end 506 comprises a substantially pointed geometry 520 with a sharp apex 502 comprising a radius of 0.050 to 0.125 inches. In some embodiments, the radius may be 0.900 to 0.110 inches. It is believed that the apex 502 is adapted to distribute impact forces across the flatted region 501, which may help prevent the diamond working end 506 from chipping or breaking. The diamond working end 506 may comprise a thickness 508 of 0.100 to 0.500 inches from the apex to the flatted region 501 or non-planar interface, preferably from 0.125 to 0.275 inches. The diamond working end 506 and the substrate 300 may comprise a total thickness 507 of 0.200 to 0.700 inches from the apex 502 to a base 503 of the substrate 300. The sharp apex 502 may allow the drill bit to more easily cleave rock or other formations.

The pointed geometry 520 of the diamond working end 506 may comprise a side which forms a 35 to 55 degree angle 555 with a central axis 304 of the cutting element 208, though the angle 555 may preferably be substantially 45 degrees. The included angle may be a 90 degree angle, although in some embodiments, the included angle is 85 to 95 degrees.

The pointed geometry 520 may also comprise a convex side or a concave side. The tapered surface of the substrate may incorporate nodules 509 at the interface between the diamond working end 506 and the substrate 300, which may provide more surface area on the substrate 300 to provide a stronger interface. The tapered surface may also incorporate grooves, dimples, protrusions, reverse dimples, or combinations thereof. The tapered surface may be convex, as in the current embodiment, though the tapered surface may be concave.

Comparing FIGS. 5 and 5*b*, the advantages of having a pointed apex 502 as opposed to a blunt apex 505 may be seen. FIG. 5 is representation of a pointed geometry 520 which was made by the inventors of the present invention, which has a 0.094 inch radius apex and a 0.150 inch thickness from the apex to the non-planar interface. FIG. 5*b* is a representation of another geometry also made by the same inventors comprising a 0.160 inch radius apex and 0.200 inch thickness from the apex to the non-planar geometry. The cutting elements were compared to each other in a drop test performed at Novatek International, Inc. located in Provo, Utah. Using an Instron Dynatup 9250G drop test machine, the cutting elements were secured in a recess in the base of the machine burying the substrate 300 portions of the cutting elements and leaving the diamond working ends 506 exposed. The base of the machine was reinforced from beneath with a solid steel pillar to make the structure more rigid so that most of the impact force was felt in the diamond working end 506 rather than being dampened. The target 510 comprising tungsten carbide 16% cobalt grade mounted in steel backed by a 19 kilogram weight was raised to the needed height required to generate the desired potential force, then dropped normally onto the cutting element. Each cutting element was tested at a starting 5 joules, if the elements withstood joules they were retested with a new carbide target 510 at an increased increment of 10 joules the cutting element failed. The pointed apex 502 of FIG. 5 surprisingly required about 5 times more joules to break than the thicker geometry of FIG. 5*b*.

It is believed that the sharper geometry of FIG. 5 penetrated deeper into the tungsten carbide target 510, thereby allowing more surface area of the diamond working ends 506 to absorb the energy from the falling target by beneficially buttressing the penetrated portion of the diamond working ends 506 effectively converting bending and shear loading of the substrate into a more beneficial compressive force drastically increasing the load carrying capabilities of the diamond working ends 506. On the other hand it is believed that since the embodiment of FIG. 5*b* is blunter the apex hardly penetrated into the tungsten carbide target 510 thereby providing little buttress support to the substrate and caused the diamond working ends 506 to fail in shear/bending at a much lower load with larger surface area using the same grade of diamond and carbide. The average embodiment of FIG. 5 broke at about 130 joules while the average geometry of FIG. 5*b* broke at about 24 joules. It is believed that since the load was distributed across a greater surface area in the embodiment of FIG. 5 it was capable of withstanding a greater impact than that of the thicker embodiment of FIG. 5*b*.

Surprisingly, in the embodiment of FIG. 5, when the super hard pointed geometry 520 finally broke, the crack initiation point 550 was below the radius of the apex. This is believed to result from the tungsten carbide target 510 pressurizing the flanks of the pointed geometry 520 in the penetrated portion, which results in the greater hydrostatic stress loading in the pointed geometry 520. It is also believed that since the radius was still intact after the break, that the pointed geometry 520 will still be able to withstand high amounts of impact, thereby prolonging the useful life of the of the pointed geometry even after chipping.

Figure 6:
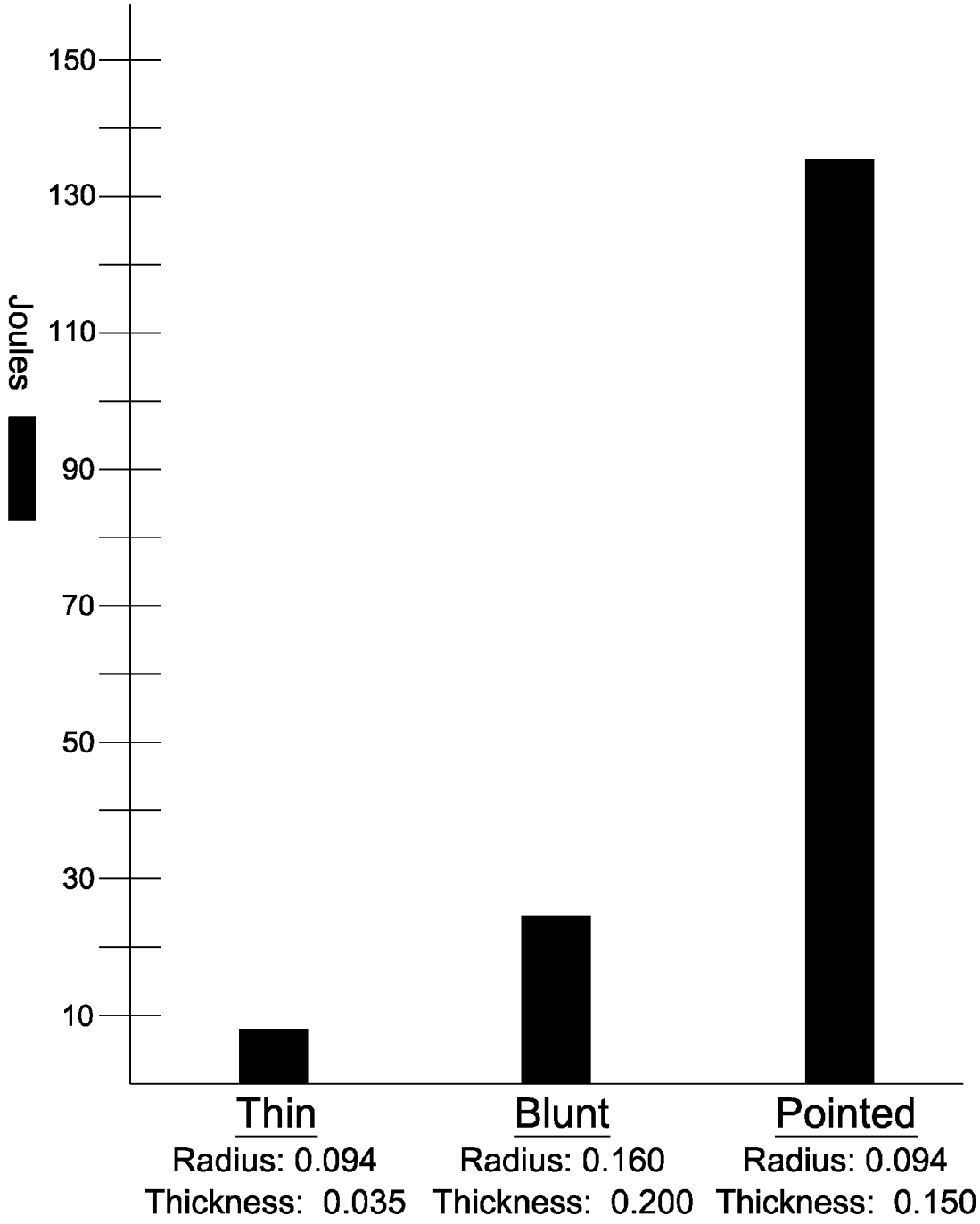
FIG. 6 is a diagram of an embodiment of test results.

FIG. 6 illustrates the results of the tests performed by Novatek, International, Inc. As can be seen, three different types of pointed insert geometries were tested. This first type of geometry is disclosed in FIG. 5*a* which comprises a 0.035 inch super hard geometry 525 and an apex with a 0.094 inch radius 526. This type of geometry broke in the 8 to 15 joules range. The blunt geometry 527 with the radius 528 of 0.160 inches and a thickness of 0.200, which the inventors believed would outperform the other geometries broke, in the 20-25 joule range. The pointed geometry 520 with the 0.094 thickness and the 0.150 inch thickness broke at about 130 joules. The impact force measured when the super hard geometry 525 with the 0.160 inch radius broke was 75 kilo-newtons. Although the Instron drop test machine was only calibrated to measure up to 88 kilo-newtons, which the pointed geometry 520 exceeded when it broke, the inventors were able to extrapolate that the pointed geometry 520 probably experienced about 105 kilo-newtons when it broke.

As can be seen, super hard material 506 having the feature of being thicker than 0.100 inches or having the feature of a 0.075 to 0.125 inch radius is not enough to achieve the diamond working end or super hard geometry 525 optimal impact resistance, but it is synergistic to combine these two features. In the prior art, it was believed that a sharp radius of 0.075 to 0.125 inches of a super hard material such as diamond would break if the apex were too sharp, thus rounded and semispherical geometries are commercially used today.

Figure 7D:
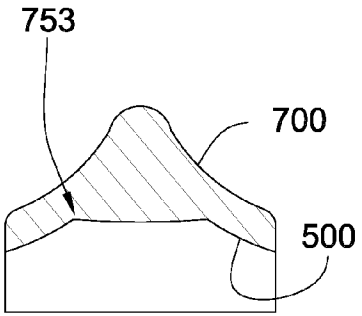
FIG. 7*d* is a cross-sectional diagram of another embodiment of a cutting element.
Figure 7C:
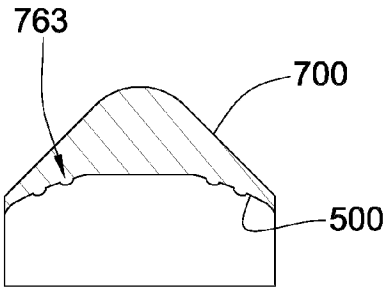
FIG. 7*c* is a cross-sectional diagram of another embodiment of a cutting element.
Figure 7B:
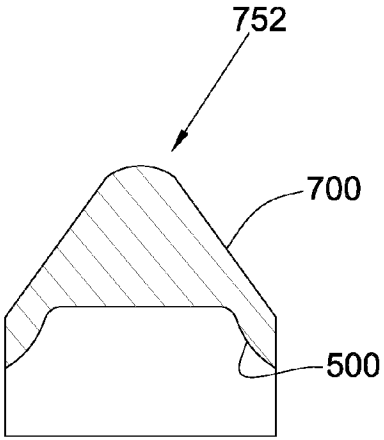
FIG. 7*b* is a cross-sectional diagram of another embodiment of a cutting element.
Figure 7A:
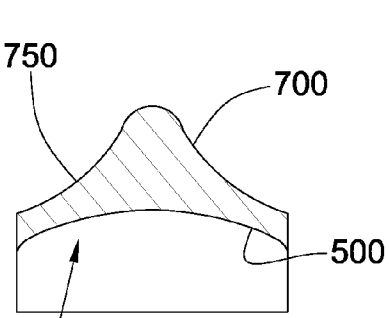
FIG. 7*a* is a cross-sectional diagram of another embodiment of a cutting element.

The performance of the present invention is not presently found in commercially available products or in the prior art. Inserts tested between 5 and 20 joules have been acceptable in most commercial applications, but not suitable for drilling very hard rock formations FIGS. 7*a* through 7*g* disclose various possible embodiments comprising different combinations of tapered surface 500 and pointed geometries 700. FIG. 7*a* illustrates the pointed geometry with a concave side 750 and a continuous convex substrate geometry 751 at the interface 500. FIG. 7*b* comprises an embodiment of a thicker super hard material 752 from the apex to the non-planar interface, while still maintaining this radius of 0.075 to 0.125 inches at the apex. FIG. 7*c* illustrates grooves 763 formed in the substrate to increase the strength of interface. FIG. 7*d* illustrates a slightly concave geometry at the interface 753 with concave sides. FIG. 7*e* discloses slightly convex sides 754 of the pointed geometry 700 while still maintaining the 0.075 to 0.125 inch radius. FIG. 7*f* discloses a flat sided pointed geometry 755. FIG. 7*g* discloses concave and convex portions 757, 756 of the substrate with a generally flatted central portion.

Figure 7H:
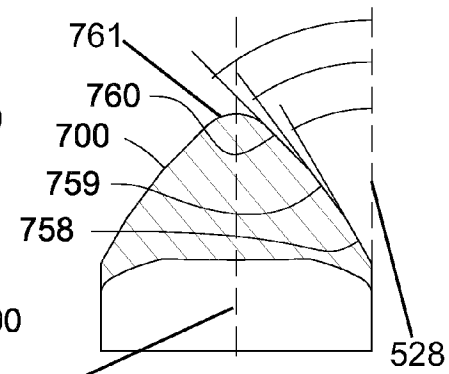
FIG. 7*h* is a cross-sectional diagram of another embodiment of a cutting element.
Figure 7G:
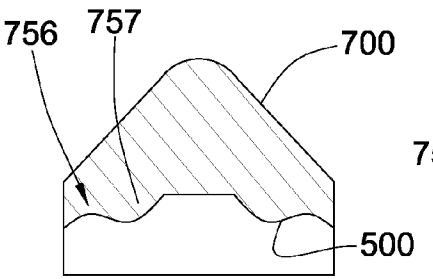
FIG. 7*g* is a cross-sectional diagram of another embodiment of a cutting element.
Figure 7F:
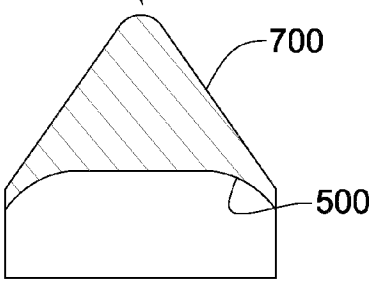
FIG. 7*f* is a cross-sectional diagram of another embodiment of a cutting element.
Figure 7E:
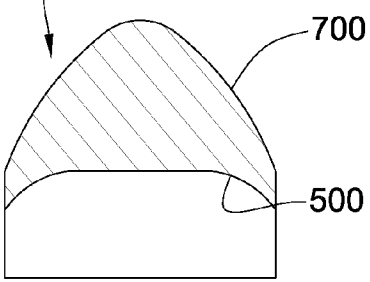
FIG. 7*e* is a cross-sectional diagram of another embodiment of a cutting element.

Now referring to FIG. 7*h*, the diamond working end 761 may comprise a convex surface comprising different general angles at a lower portion 758, a middle portion 759 and an upper portion 760 with respect to the central axis 762 of the tool. The lower portion 758 of the side surface may be angled at substantially 25 to 33 degrees from the central axis, the middle portion 759, which may make up a majority of the convex surface, may be angled at substantially 33 to 40 degrees from the central axis, and the upper portion 760 of the side surface may be angled at about 40 to 50 degrees from the central axis.

Figure 8:
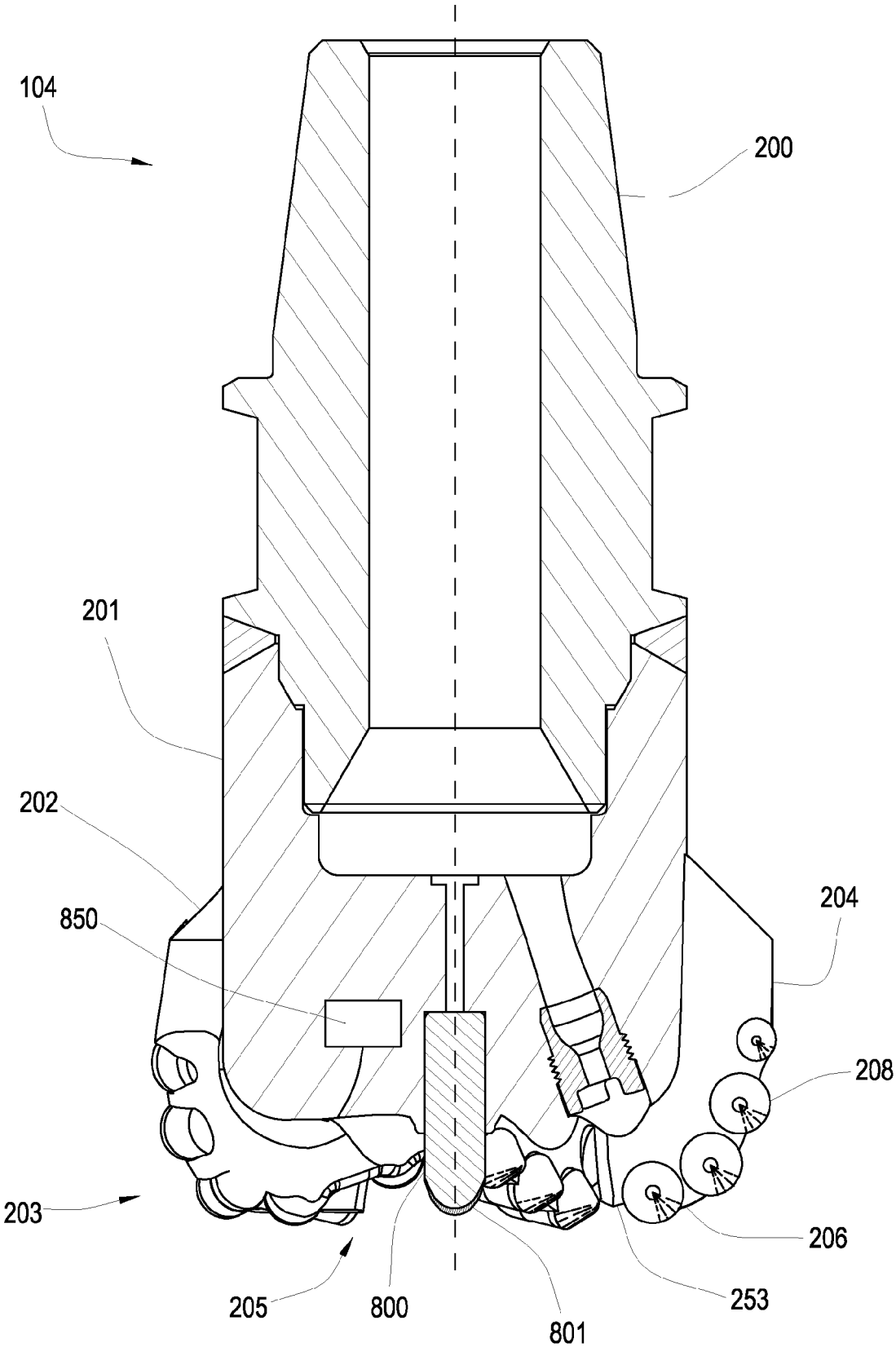
FIG. 8 is a cross-sectional diagram of an embodiment of a drill bit.

FIG. 8 discloses an embodiment of the drill bit 104 with a jack element 800. The jack element 800 comprises a hard surface of a least 63 HRc. The hard surface may be attached to the distal end 801 of the jack element 800, but it may also be attached to any portion of the jack element 800. In some embodiments, the jack element 800 is made of the material of at least 63 HRc. In the preferred embodiment, the jack element 800 comprises tungsten carbide with polycrystalline diamond bonded to its distal end 801. In some embodiments, the distal end 801 of the jack element 800 comprises a diamond or cubic boron nitride surface. The diamond may be selected from group consisting of polycrystalline diamond, natural diamond, synthetic diamond, vapor deposited diamond, silicon bonded diamond, cobalt bonded diamond, thermally stable diamond, polycrystalline diamond with a cobalt concentration of 1 to 40 weight percent, infiltrated diamond, layered diamond, polished diamond, course diamond, fine diamond or combinations thereof. In some embodiments, the jack element 800 is made primarily from a cemented carbide with a binder concentration of 1 to 40 weight percent, preferably of cobalt. The working face 202 of the drill bit 104 may be made of a steel, a matrix, or a carbide as well. The cutting elements 208 or distal end 801 of the jack element 800 may also be made out of hardened steel or may comprise a coating of chromium, titanium, aluminum or combinations thereof.

One long standing problem in the industry is that cutting elements 208, such as diamond cutting elements, chip or wear in hard formations 105 when the drill bit 104 is used too aggressively. To minimize cutting element 208 damage, the drillers will reduce the rotational speed of the bit 104, but all too often, a hard formation 105 is encountered before it is detected and before the driller has time to react. The jack element 800 may limit the depth of cut that the drill bit 104 may achieve per rotation in hard formations 105 because the jack element 800 actually jacks the drill bit 104 thereby slowing its penetration in the unforeseen hard formations 105. If the formation 105 is soft, the formation 105 may not be able to resist the weight on bit (WOB) loaded to the jack element 800 and a minimal amount of jacking may take place. But in hard formations 105, the formation 105 may be able to resist the jack element 800, thereby lifting the drill bit 104 as the cutting elements 208 remove a volume of the formation during each rotation. As the drill bit 104 rotates and more volume is removed by the cutting elements 208 and drilling mud, less WOB will be loaded to the cutting elements 208 and more WOB will be loaded to the jack element 800. Depending on the hardness of the formation 105, enough WOB will be focused immediately in front of the jack element 800 such that the hard formation 105 will compressively fail, weakening the hardness of the formation and allowing the cutting elements 208 to remove an increased volume with a minimal amount of damage.

In some embodiments of the present invention, at least one of the cutting elements with a pointed geometry may be in electrical communication with downhole instrumentation. The instrumentation may be a transducer, a piezoelectric device, a magnetostrictive device, or a combination thereof. The transducer may be able to record the bit vibrations or acoustic signals downhole which may aid in identifying formation density, formation type, compressive strength of the formation, elasticity of the formation, stringers, or a combination thereof.

Figure 9:
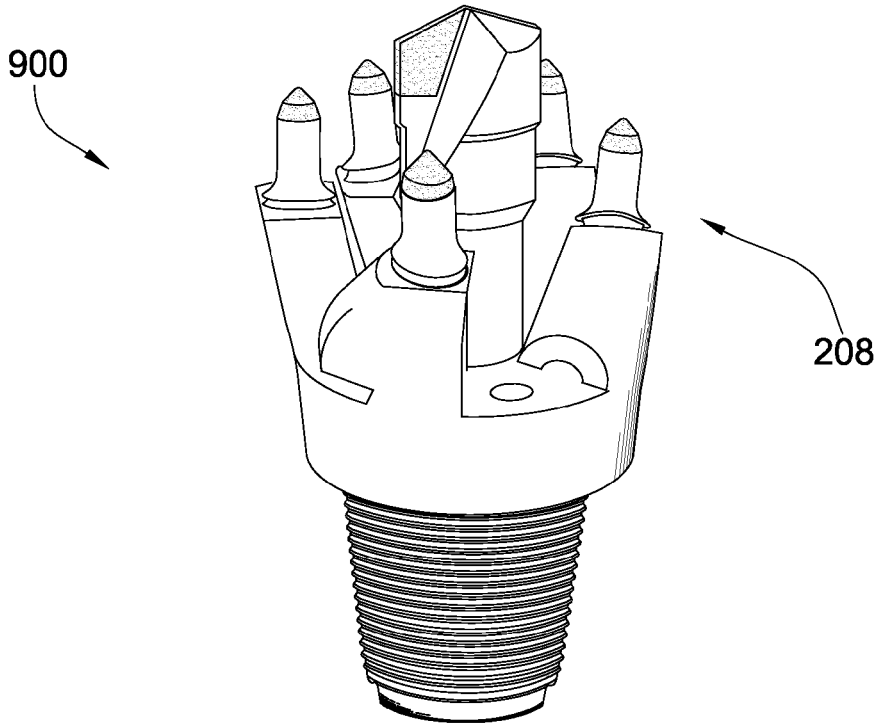
FIG. 9 is a perspective diagram of another embodiment of a drill bit.
Figure 9A:
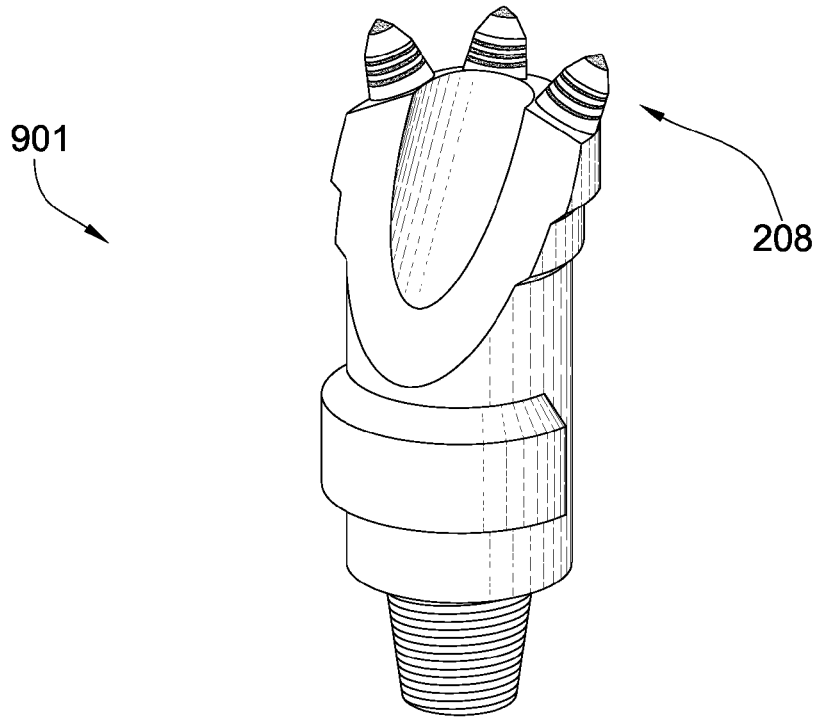
FIG. 9*a* is a perspective diagram of another embodiment of a drill bit.

FIG. 9 discloses a drill bit 900 typically used in water well drilling. FIG. 9*a* discloses a drill bit 901 typically used in subterranean, horizontal drilling. These bits 900, 901, and other bits, may be consistent with the present invention.

Figure 10:
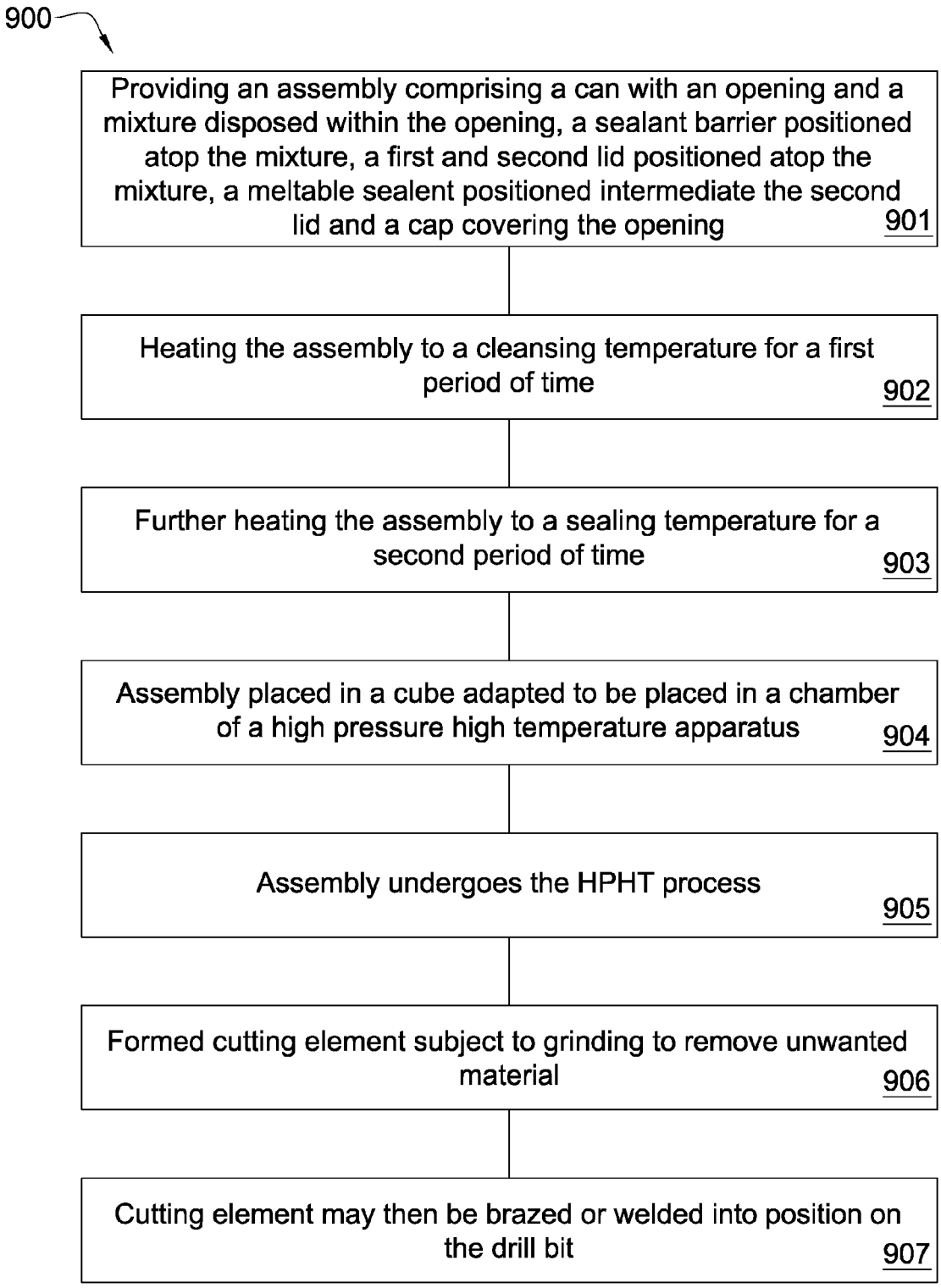
FIG. 10 is a method of an embodiment for fabricating a drill bit.

FIG. 10 is a method 1000 of an embodiment for preparing a cutting element 208 for a drill bit 104. The method 1000 may include the steps of providing 1001 an assembly 400 comprising a can with an opening and constituents disposed within the opening, a stop off positioned atop the constituents, a first and second lid positioned atop the constituents, a meltable sealant positioned intermediate the second lid and a cap covering the opening; heating 1002 the assembly 400 to a cleansing temperature for a first period of time; further heating 1003 the assembly 400 to a sealing temperature for a second period of time. In one embodiment the assembly 400 may be heated to the cleansing temperature in a vacuum and then brought back to atmospheric pressure in an inert gas. The assembly 400 may then be brought to the sealing temperature while in an inert gas. This may create a more stable assembly 400 because the internal pressure of the assembly 400 may be the same as the pressure out side of the assembly 400. This type of assembly 400 may also be less prone to leaks and contamination during HPHT processing and transportation to the processing site. The assembly may then be placed in a cube adapted to be placed in a chamber of a high pressure high temperature apparatus 1004 where it may undergo the HPHT process 1005. Completing the HPHT process, the newly formed cutting element 208 may be subject to grinding to remove unwanted material 1006. The cutting element 208 may then be brazed or welded 1007 into position on the drill bit 104.

Whereas the present invention has been described in particular relation to the drawings attached hereto, it should be understood that other and further modifications apart from those shown or suggested herein, may be made within the scope and spirit of the present invention.

What is claimed is:

1. A rotary drag bit for drilling underground into a formation, said rotary drag bit comprising:

a shank;

a bit body attached to said shank, said bit body having a working surface that includes at least one blade for engaging said formation; and at least one cutting element attached to each of said at least one blade, each of said at least one cutting element being oriented at a rake angle to engage said formation, said cutting element including a substrate having a bonding surface including a flatted area positioned with a tapered surface extending downward therefrom, and a working end formed of a diamond material bonded to said bonding surface, said working end being formed to have a tip.

2. The rotary drag bit 1, wherein the rake angle is from about 15 degrees positive to about 15 degrees negative.

3. The rotary drag bit of claim 1, wherein said tip of said working end has a pointed geometry and wherein said diamond material has a thickness from about 0.100 inches to about 0.250 inches.

4. The rotary drag bit of claim 2, wherein the cutting element has an axis and wherein said cutting element is positioned at about a zero rake angle.

5. The rotary drag bit of claim 3, wherein said tip has a radius from 0.050 inches to about 0.200 inches.

6. The bit of claim 5, wherein the tip has a radius from about 0.090 inches to about 0.100 inches.

7. The rotary drag bit of claim 6, wherein said tip has a radius of about 0.94 inches.

8. The rotary drag bit of claim 1, wherein the rotary drag bit includes a jack element having a distal end extending outwardly from said bit body.

9. The rotary drag bit of claim 1, wherein said diamond material includes less than 5 percent by volume of a metal catalyst.

10. The rotary drag bit of claim 1, wherein the substrate is a carbide material and wherein said bonding surface has surface irregularities formed therein.

11. The rotary drag bit of claim 10, wherein said surface irregularities are nodules.

12. The bit of claim 8, wherein each of said at least one blade includes a plurality of said cutting elements.

13. The rotary drag bit of claim 1, wherein each of said at least one blade includes a flat cutting element having a working end that has an essentially planar surface for engaging said formation, said working end being formed from a diamond material.

14. The rotary drag bit of claim 1 further including a plurality of nozzles formed in said bit body and positioned to supply and remove drilling mud proximate said at least one cutting element.

15. The rotary drag bit of claim 1 further including a jack element attached to said bit body to extend downwardly therefrom to engage said material.

16. The rotary drag bit of claim 1 wherein said cutting element is of the type that has been formed in a processing assembly comprising:

a can having a side wall with an outside surface, a bottom attached to said side wall and an open end opposite said bottom, said bottom being configured to form a material contacting surface of a cutting element, said can being sized to hold said cutting element when formed, and said side wall having an upper portion moveable from an upright position in which said upper portion is in alignment with another portion of said side wall to a folded position in which said upper portion is substantially normal to said wall;

a stop off for placement over a base when said base is in said can, said stop off being positioned between said cutting element and said upper portion of said side wall when said upper portion is in said folded position;

a first lid positioned over said stop off, said first lid being positioned between said stop off and said upper portion of said side wall when said upper portion is in said folded position;

a second lid positioned over said side wall in said folded position;

a sealant positioned over said second lid, said sealant being flowable when heated; and a cap sized to fit over said sealant, said cap having a side that extends along said outside surface of said side wall and below said upper portion of said side wall when said upper portion is in said folded position.

17. The rotary drag bit of claim 1 wherein said substrate is made of a metal at a hardness of at least 58 on the Rockwell Hardness 'C' scale.

18. A rotary drag bit for drilling underground into a formation, said rotary drag bit comprising:

a shank for connecting to a source of drilling power;

a bit body attached to said shank, said bit body having a working surface that includes a plurality of blades; and at least one cutting element attached to each of said plurality of blades, each of said at least one cutting element having a working end oriented to engage said formation to be drilled at a rake angle from about 0 degrees to about 15 degrees, said cutting element including a substrate having a bonding surface with said working end bonded thereto, said working end being formed from a diamond material, and said working end being formed with a tip having a radius from about 0.050 to about 0.200 inches and a thickness from about 0.100 to about 0.250 inches.

19. The rotary drag bit of claim 18 wherein said tip has a radius of about 0.094 inches.

20. The rotary drag bit of claim 18 wherein said diamond material includes less than 5% of a metal catalyst by volume.

21. The rotary drag bit of claim 20 wherein the diamond material includes infiltrated diamond material.

22. The rotary drag bit of claim 18 wherein the diamond material is granular and has a grain size from about 1 to about 100 microns.

23. The rotary drag bit of claim 18 further including a jack element attached to said bit body, said jack element including a working face and a base made of cemented carbide and a binder including from about 1 to about 40 percent by weight of cobalt between said working face and said base.

* * * * *